US007896726B1

(12) United States Patent
Miller et al.

(10) Patent No.: US 7,896,726 B1
(45) Date of Patent: Mar. 1, 2011

(54) METHOD AND APPARATUS FOR REMOVING COATINGS FROM A SUBSTRATE USING MULTIPLE SEQUENTIAL STEPS

(75) Inventors: Mitchell O. Miller, Kings Mountain, NC (US); William R. Pearson, Kings Mountain, NC (US); William R. Thompson, Greenville, SC (US)

(73) Assignee: Huffman Corporation, Clover, SC (US)

( * ) Notice: Subject to any disclaimer, the term of this patent is extended or adjusted under 35 U.S.C. 154(b) by 29 days.

(21) Appl. No.: 12/383,096

(22) Filed: Mar. 19, 2009

Related U.S. Application Data

(62) Division of application No. 11/999,667, filed on Dec. 6, 2007, now Pat. No. 7,544,112.

(60) Provisional application No. 60/874,571, filed on Dec. 13, 2006.

(51) Int. Cl.
*B24B 49/00* (2006.01)

(52) U.S. Cl. ..... 451/2; 451/5; 451/10; 451/11; 451/38; 451/75

(58) Field of Classification Search ..... 451/2, 451/5, 10, 11, 38, 37, 40, 75, 80, 84
See application file for complete search history.

(56) References Cited

U.S. PATENT DOCUMENTS 5,573,446 A * 11/1996 Dey et al. ..... 451/39
6,120,351 A * 9/2000 Zeng ..... 451/28
6,165,057 A * 12/2000 Gill, Jr. ..... 451/287
6,502,442 B2 * 1/2003 Arola et al. ..... 72/53
6,540,587 B1 * 4/2003 Gotkis et al. ..... 451/5
6,663,919 B2 * 12/2003 Farmer et al. ..... 427/453
6,905,396 B1 * 6/2005 Miller et al. ..... 451/38
7,335,089 B1 * 2/2008 Thompson et al. ..... 451/38
2002/0173238 A1 * 11/2002 Kordonski et al. ..... 451/36
2003/0003849 A1 * 1/2003 Groman ..... 451/36
2004/0256504 A1 * 12/2004 Segrest et al. ..... 241/1
2005/0227587 A1 * 10/2005 Yang ..... 451/6
2007/0167113 A1 * 7/2007 Klein et al. ..... 451/6
2008/0153390 A1 * 6/2008 Thompson ..... 451/5
2008/0166948 A1 * 7/2008 Bhagavat et al. ..... 451/5
2008/0274671 A1 * 11/2008 O'Donoghue et al. ..... 451/39
2009/0311416 A1 * 12/2009 Nelson et al. ..... 427/8

OTHER PUBLICATIONS

*Working Under Pressure*, Engine Yearbook 2002, pp. 108-111.

* cited by examiner

*Primary Examiner*—Eileen P. Morgan
(74) *Attorney, Agent, or Firm*—K&L Gates LLP

(57) ABSTRACT

A method and apparatus for removing a coating having an irregular surface configuration that includes mapping the irregular surface configuration, and using the mapping determination in controlling the operation of an abrasive water jet to provide increased material removal rates at the higher points in the irregular surface and decreased material removal rates at the lower points, and thereby even out the surface configuration of the coating. The method and apparatus also includes using a detection device for detecting the presence or absence of an element that is unique to a layer of a coating, and using the detection determination in controlling the operation of the abrasive water jet to stop material removal of the coating when the detection device determines there is an absence of the unique element.

6 Claims, 3 Drawing Sheets

METHOD AND APPARATUS FOR REMOVING COATINGS FROM A SUBSTRATE USING MULTIPLE SEQUENTIAL STEPS

CROSS-REFERENCE TO RELATED APPLICATIONS

This application is a divisional of and thus is entitled to the benefit of, and claims priority to, U.S. patent application Ser. No. 11/999,667, filed Dec. 6, 2007, and entitled "Method And Apparatus For Removing Coatings From A Substrate Using Multiple Sequential Steps," which claims priority of provisional U.S. Patent Application Ser. No. 60/874,571, filed on Dec. 13, 2006, and entitled "Method And Apparatus For Removing Coatings From A Substrate Using Multiple Sequential Steps," the disclosures of which are incorporated herein by reference as if set forth fully herein.

BACKGROUND OF THE PRESENT INVENTION

The present invention relates generally to a method and apparatus for removing coatings from a workpiece or substrate, and more particularly to a method and apparatus for removing such coatings in a controlled sequence of steps.

Some types of workpieces and parts require that one or more layers of coatings be applied to the workpiece to protect the underlying base metal from heat, abrasion, and other elements encountered by the workpiece in its normal usage. For example, turbine blades and other turbine parts may be formed of a base metal, a bond coating that is often diffusion bonded metallurgically to the base metal, and an outer thermal barrier coating (TBC) applied to the bond coat. As is well known, the composition of the TBC (e.g. ceramic) makes it relatively easy to remove using manual grinding, dry grit blasting, chemical stripping and water jet stripping. However, as set forth in greater detail in U.S. Pat. No. 6,905,396, which is incorporated herein by reference, all of these known manually applied removal methods have various drawbacks in that they are not particularly effective in removing the more difficult bond coat, and, in the case of acid or chemical stripping, environmental problems are encountered and there is a tendency to damage the underlying base metal as part of the removal process.

The invention described in the aforesaid '396 patent provides for a controlled removal method that can be carried out using an abrasive water jet that is mechanically, rather than manually, operated to move relative to the workpiece and thereby remove coatings from the base metal as the abrasive water jet is passed relative to the surface of the workpiece. However, even though the relative movement of the abrasive water jet across the workpiece surface is controlled, the abrasive water jet itself generally removes substantially equal amounts of the coatings during each pass of the abrasive water jet, and the abrasive water jet is not controlled in a way that would properly compensate for variations in the thickness of the TBC caused by the use of the workpiece, such as a turbine blade. Additionally, because of variations in the overall thickness of the coatings to be removed, the relatively constant flow of the abrasive jet would sometimes remove more or less of the base metal than was desired.

Accordingly, a need exists for a method of removing layers of coatings in a controlled manner that compensates for variations in the overall thickness of the coatings. A need also exists for such a method that is controlled in a way that it removes a desired small amount of the base metal, such as the diffusion layer formed when a bond coat is diffusion bonded to the base metal, to provide a clean, pristine surface on the base metal after the coatings have been removed so that new coatings can be applied to the base metal.

SUMMARY OF THE INVENTION

The present invention provides an abrasive water jet apparatus for removing a coating from the surface of a workpiece in which the coating has an irregular exterior surface configuration with high and low points. The apparatus includes a workpiece holding system for holding and the workpiece; a movable abrasive water jet that discharges a high pressure jet of water having an entrained abrasive material against and along the coating of the workpiece held by the work holding system to remove the coating therefrom at variable material removal rates; and a sensor mounted generally adjacent the work holding system that senses the topography of the irregular exterior surface of the coating at a plurality of points and transmits electrical signals that are a function of the thickness of the coating at the plurality of sensed points. The apparatus also includes a control system that receives the signals from the sensor and controls the movement and operation of an abrasive water jet to make multiple passes relative to the surface of the workpiece in which a small layer of the coating is removed during each pass and to even out the irregular surface configuration of the coating by operating the abrasive water jet at higher material removal rates when the abrasive water jet passes the higher points in the surface configuration and at lower material removal rates when the abrasive water jet passes the lower points in the surface configuration.

The workpiece may be a turbine component formed of a base metal, a bond coat diffusion bonded to the base metal and overcoated with a TBC having the irregular surface configuration, and the control system can control the abrasive water jet to remove the entire TBC down to the bond coat.

The sensor may be a touch probe than engages the surface of the coating to be removed, or an Eddy current probe that senses the thickness of the coating.

The abrasive water jet apparatus of the present invention may be used to remove a bond coat that is diffusion bonded to a base metal of a workpiece in which a diffusion layer having at least one unique element is formed between the bond coat and the base metal. The apparatus includes the workpiece holding system and abrasive water jet as described above, and a detection device mounted generally adjacent the work holding system that detects the presence or absence of the unique element in the diffusion layer and transmits electrical signals to the control system that indicate whether the unique element is present or absent, and the control system receives the signals from the detection device and controls to the movement and operation of an abrasive water jet to make multiple passes relative to the surface of the workpiece in which a small layer of the bond coat and then the diffusion layer is removed, and to stop the removal of material by the abrasive water jet when the control system receives a signal from the detection device indicating the absence of the unique element.

Preferably, the detection device is a XFR analyzer and the unique element in the diffusion layer is Yttrium.

The present invention also provides a method of removing a coating from the surface of a substrate in which the coating has an irregular exterior surface configuration with high and low points, such method comprising the steps of (a) mapping the topography of the irregular surface configuration of the coating to be removed; (b) using the topography information determined by the mapping step to create an input into a control system that controls the operation and movement of an abrasive water jet apparatus; and (c) utilizing the control system to control the movement and operation of an abrasive water jet to make multiple passes relative to the surface of the substrate in which a small layer of the coating is removed during each pass and to even out the irregular surface configuration of the substrate by operating the abrasive water jet at higher material removal rates when the abrasive water jet passes the higher points in the surface configuration and at lower material removal rates when the abrasive water jet passes the lower points in the surface configuration.

In one preferred embodiment of this method, the mapping step includes moving the substrate relative to a probe with the probe engaging the irregular surface configuration of the substrate at predetermined probe points to generate electrical signals that are a function of the irregular surface configuration at the probe points, and wherein the electrical signals are transmitted to a programmed computer in the control system. The mapping step may include using an Eddy current probe for determining the thickness of the irregular surface configuration, and generating electrical signals that are a function of the thickness of the irregular surface configuration.

In this method, the abrasive water jet apparatus may include a workpiece holder for holding the substrate relative to the movable abrasive water jet, and the method includes the step of positioning the abrasive water jet generally adjacent the probe so that the probe can move relative to the workpiece during the mapping step and the abrasive water jet and the abrasive water jet can move relative to the workpiece during the material removal step.

The present invention also includes a method of removing a bond coat diffusion bonded to a base metal and removing the diffusion layer between the bond coat and the base metal, the diffusion layer having an element that is unique to the diffusion layer. This method includes the steps of removing the bond coat material by moving an abrasive water jet relative to the bond coat and the base metal in multiple passes and in sequential steps; detecting the presence or absence of the unique element in the diffusion layer after predetermined passes of the abrasive water jet; and stopping the movement and operation of the abrasive water jet when the presence of the unique element is no longer detected.

Additionally, the detection devices may detect the amount of the unique element that is present at the surface of the diffusion layer during passes of the workpiece relative to the detection device, and the signals transmitted to the control system by the detection device can indicate the amount of the unique element that present at the surface of the diffusion layer. The control system determines the amount of the unique element that is removed during predetermined passes of the workpiece and the differential between the amount of the unique element that is removed during such passes, and the control system controls the operation of the abrasive water jet and the movable workpiece holder to increase the material removal rate when the differential is less than a predetermined amount and to decrease the material removal rate when the differential is greater than a predetermined amount.

In this method, the detection step may include using an x-ray fluorescence detector, and moving the detector relative to the surface in which the presence or absence of the unique element is to be detected. The unique element of the diffusion layer may be Yttrium.

This method may used with an abrasive water jet apparatus that includes a movable workpiece holder for holding the surface to be detected relative to the movable abrasive water jet, and the method includes the step of positioning the abrasive water jet generally adjacent the detector so that the abrasive water jet can move relative to the workpiece relative to the abrasive water jet during the material removal step and the detection device can move relative to the workpiece during the element detection step.

DESCRIPTION OF THE PREFERRED EMBODIMENTS

In describing the invention below, the substrate will sometimes be identified as a turbine blade, which is a typical machine part having coatings that are removable using the method of the present invention, but it is to be understood that the present invention could also be used in removing coatings from a variety of other substrates and machine parts, such as vanes, shrouds, liners and transition pieces.

Figure 1:
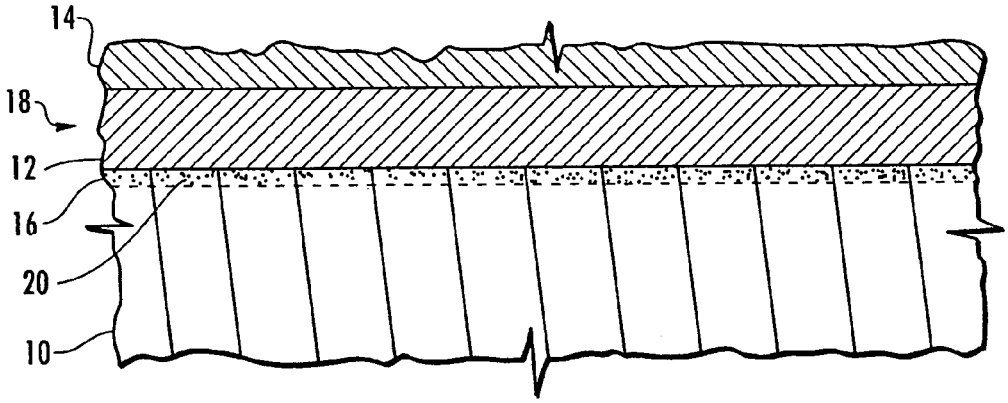
FIG. 1 is a cross-sectional view of a typical substrate having coatings that can be removed by the present invention.

As seen in FIG. 1, the turbine blade 18 consists of a base metal 10 to which a bond coat 12 is diffusion bonded metallurgically to the base metal 10. The bond coat 12 is then overcoated with a ceramic material to form a TBC 14. It will be noted that the TBC 14 has a very irregular thickness and surface configuration which is a result of heat and other elements applied to the turbine blade in use, and this irregular surface configuration is exaggerated in FIG. 1 for purposes of illustration. Additionally, it will be noted that when the bond coat 12 is diffusion bonded to the base metal 10, there is a relatively thin diffusion layer 16 that is inherently formed as part of the diffusion bonding process. This diffusion layer 16 may, and usually does, include foreign matter such as dirt and the like and often includes surface cracking 20, sometimes referred to as "craze cracking", all of which is undesirable as a surface upon which a new coating can be applied with a very secure bond after the old coatings have been removed. Accordingly, one feature of the method and apparatus of the present invention is that it can be utilized to not only remove the TBC and the bond coat, it can be effectively used to also remove just enough of the base metal to remove the diffusion layer 16 and thereby leave the cleaned surface of the base metal 10 as a pristine surface without cracking or the presence of foreign matter that could adversely effect the new bond coat when it is applied to the base metal.

Figure 2:
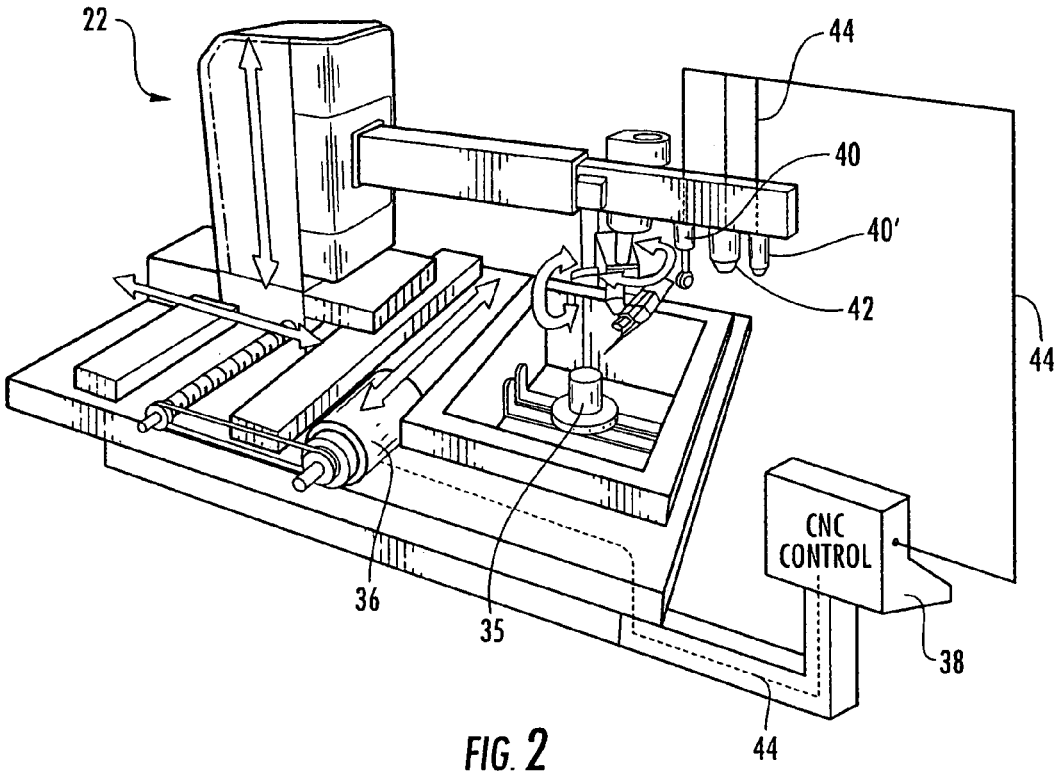
FIG. 2 is a general perspective view of the preferred abrasive jet apparatus of the present invention.
Figure 3:
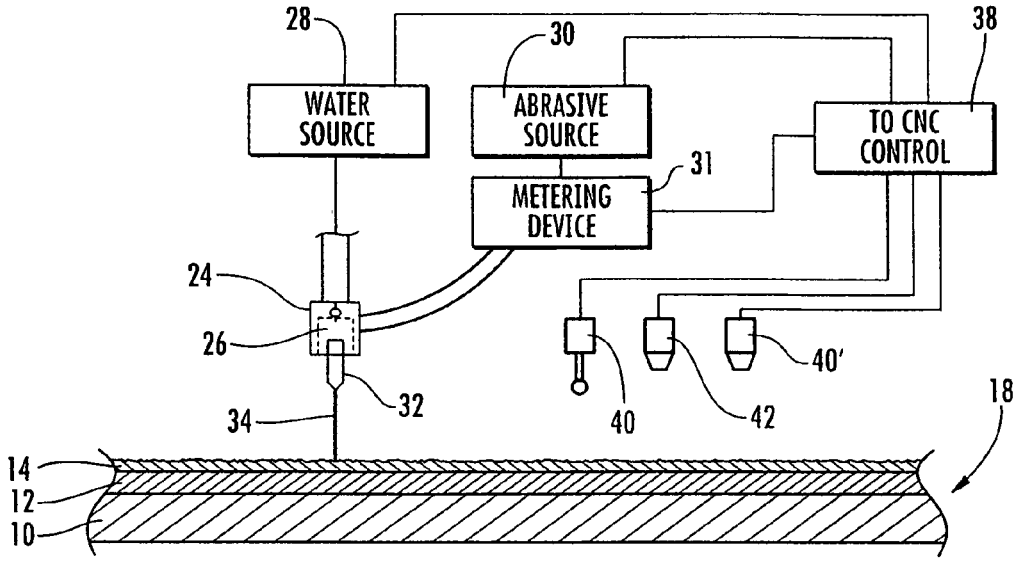
FIG. 3 is a diagrammatic view of the abrasive jet acting against a substrate, and related elements of the present invention.

In one preferred embodiment of the present invention, removal of the coatings is carried out using a known abrasive jet apparatus of the type disclosed in more detail in the aforesaid '396 patent, which is enhanced in accordance with the present invention as described in greater detail below. The details of the abrasive water jet apparatus itself, as disclosed in the '396 patent, form no part of the present invention, and these basic components of the abrasive water jet apparatus 22 are illustrated in FIGS. 2 and 3. They include a distribution head 24 having a mixing chamber 26 from which a pressurized liquid (e.g. water) is provided to the mixing chamber 26 from a water source 28. The apparatus 22 includes a source 30 of an abrasive material which is also delivered to the mixing chamber 26, and the combined water and abrasive is delivered from a delivery nozzle 32 as a jetted fluid stream or abrasive water jet 34, usually in the range of 5,000 psi to 55,000 psi. As best seen in FIG. 2, the delivery nozzle 32 is manipulated relative to the workpiece about a plurality of axes (indicated by arrows) by a workpiece holding system 35 that includes by a plurality of motors 36, only one of which is shown diagrammatically in FIG. 2, and these motors are controlled though a conventional control system 38 that includes a conventional programmable computer to position and move the workpiece so that the delivery nozzle 32 has relative movement along a desired path across workpiece, and to properly control the various parameters associated with the apparatus 22 (e.g. the amount of the abrasive delivered to the mixing chamber 26 and the pressure of the abrasive water jet 34 exiting the delivery nozzle 32) to vary the material removal rate of the abrasive water jet 34.

The conventional abrasive water jet apparatus 22 described above is modified in accordance with the present invention to include a tool 40 for mapping the surface configuration of a substrate and generating signals that are a function of the irregular surface configuration and transmitting these signals to the control system 38, and a detection device 42 for detecting the presence or absence of an element that is unique to an element in the substrate and generating and transmitting signals to the control system 38, all as will be described in greater detail below.

In the present invention, the workpiece 18, such as a turbine blade, from which coatings 12 and 14 (see FIG. 1) are to be removed is probed by the tool 40 to map the topography of the irregular surface configuration of the outer coating 14. The tool 40 is a conventional digitizing device such as touch probes, x-rays, eddy-current probes, laser probes and scanners, structured light scanners, and the like. It is moved relative to the irregular surface configuration and generates electrical signals at predetermined probe points during such movement that are a function of the topography of the surface configuration of the outer coating 14 of the turbine blade 18. These signals are then delivered through electrical lines 44 to the computer 38 which has software that is programmed to store the signals and to utilize the signals as part of the control the operation of an abrasive jet apparatus 22. More specifically, since the topography of the irregular surface configuration (e.g. higher and lower points along the surface configuration of the turbine blade 18) is programmed in the computer 38 of the abrasive jet apparatus 22, the abrasive jet apparatus 22 can be controlled by the computer 38 to control the various parameters of the system (e.g. the amount of the water pressure generated by the jet, the amount of abrasive material entrained in the water jet, and other variables) and thereby vary the material removal rate of the abrasive water jet 34 so that as the abrasive water jet 34 is moved relative to the irregular surface configuration of the turbine blade 18, more of the TBC coating 14 will be removed at the higher points of the surface configuration as determined by the mapping, and less coating material is removed at the lower spots. As a result, after this first step is carried out, the surface configuration of the coating will be approximately smooth, but it will be understood that this first step could include one or multiple passes of the abrasive water jet 34 relative to the surface of the turbine blade 18. In most cases, this first step removes the TBC, which is relatively easy to remove, and creates a generally smooth surface configuration along the remaining bond coat 12. It will be understood that this step of mapping the topography of one layer of coating and then controlling the abrasive water jet 34 to smooth out the uneven surface can be used not only where multiple layers of coatings are present in the workpiece, but also on a unitary substrate that has a uneven surface configuration like that shown for the TBC 14 in FIG. 1.

Next, the abrasive water jet apparatus 22 is controlled so that it moves relative to the surface of the bond coat 12 at a generally uniform speed and at a generally uniform material removal rate so that a relatively thin but uniform portion of the bond coat is removed during each pass of the abrasive water jet 34. During this step, in most cases there will be multiple passes of the abrasive water jet 34, with only a small amount of the bond coat 12 being removed during each pass, whereby it will be easier and more accurate to determine when the undesirable diffusion layer 16 has been completely removed without removing any more of the base metal 10 than is necessary to remove the diffusion layer 16.

In accordance with a further feature of the present invention, the removal process described above can be significantly enhanced in many applications by utilizing the detection device 42 to detect the presence or absence of an element that is unique to the coating to be removed. For example, in one bond coat 12 that is applied to a turbine blade 18, Yttrium is a unique element of the bond coat, and Yttrium can be detected by the detection device 42. Accordingly, at the conclusion of each pass of the abrasive water jet 34 relative to the surface of the bond coat 12 that removes a thin layer thereof, detection device 42 is used to test the exposed surface of the bond coat 12 and generate an electrical signal that indicates whether the unique element is present or absent, and this electrical signal is transmitted to the control system 38 through electrical lines 44. If Yttrium is detected, this indicates that some of the diffusion layer 16 still remains on the base metal 10, and it is therefore necessary for the control system 38 to control the apparatus so the abrasive water jet 34 makes another pass or passes relative to the surface of the turbine blade 18. At some point, after a pass of the abrasive water jet 34, the detection device 42 will detect that no Yttrium is present and transmit an electrical signal to the computer. At that point, it can be safely determined that all of the diffusion layer 16 has been removed from the base metal 10, leaving a pure and pristine base metal surface upon which a new coating can be securely applied, and the control system 38 is programmed to stop further operation of the abrasive water jet 34 and thereby stop the further removal of material from the base metal 10. It will be appreciated that the diffusion layer 16 is normally relatively small in thickness (e.g. perhaps 0.001 to 0.002 inches), and the combination offered by the present invention of removing only a thin layer of the bond coat 12 on each pass, and then detecting the presence or absence of an element that is unique to the diffusion layer (e.g. Yttrium) makes it possible to effectively remove just the diffusion layer without removing, unnecessarily, any additional base metal material 10. While Yttrium is an element that is unique to most bond coats used in turbine components, it will be appreciated that other types of coatings can be removed utilizing the present invention, and the element that is unique to such coatings may be different from Yttrium, and the detection device 42 will have to be selected based on its ability to detect that unique element.

In addition to using the signals from the detection device 42 to determine just the presence and absence of the unique element, the signals from the detection device 42 can also be used to control the rate of material removal by the abrasive jet apparatus 22. More specifically, the signal transmitted to the control system 38 by the detection device 42 can, in addition to indicating the presence or absence of the unique element, indicate the amount of the unique element that is present. The control system 38 can be programmed to analyze the signals and determine the amount of the unique element that is removed during each of a sequence of passes based on the signals it receives from the detection device 42 and determine the differential between the amounts removed during successive passes, and if the differential of the amount of the unique element that is removed from one pass to the next is smaller than a predetermined level, which would indicate that smaller amounts of the coating material are being removed than desired, the apparatus 22 can be controlled to vary the operating parameters of the apparatus 22 to increase the material removal rate of the abrasive water jet 34 applied on subsequent passes and thereby increase the amount of the coating removed during each pass. Similarly, if the differential is larger than the predetermined level, the apparatus 22 can be controlled to decrease the material removal rate of the abrasive water jet 34 on subsequent passes.

When the detection device 42 is used to detect the presence or absence of Yttrium or some other unique element, it can be manually moved relative to the surface that is being detected, but, in accordance with the present invention, it is preferred that the detection device 42 be carried on the abrasive jet apparatus 22 generally adjacent the delivery nozzle 32 as illustrated in FIGS. 2 and 3 so that it is an integral part of the abrasive water jet apparatus 22 which can be operated by the control system 38 for the apparatus 22 to move with the abrasive water jet 34 relative to workpiece 18 during the detection step.

The mapping step for determining the topography of the coating to be removed can be carried out in different ways, depending on the particular application of the removal method. For example, if it is determined that it is only necessary to ultimately even out the high and low points of a TBC, probing of the TBC can be done using a conventional Eddy current probe 40' to determine the topography or thickness of the TBC that is to be removed, and the Eddy current probe 40' can then be used to generate the electrical signals that are transmitted to the computer 38 to control the movement of the abrasive water jet 34 relative to the surface of the TBC as described above. On the other hand, since an Eddy current probe 40' is not suitable for mapping the high and low variations in the TBC, a coordinate measuring machine (CMM) can be used as the mapping tool 40 to map the topography of the coating, and then generating electrical signals which are a function of the higher and lower points along the surface of the coating that are transmitted to the computer 38 for controlling the operation of the abrasive water jet apparatus 22. The Eddy current probe 40' effectively measures the actual thickness of the TBC, and therefore can determine the high points and low points in the TBC by determining the actual thickness of the coating at the probe point. The CMM 40 does not measure the thickness of a coating, but, rather, engages the surface and directly detects higher and lower points in the topography of the coating. Therefore, in some applications of the coating removal method of the present invention which utilizes the mapping step, the removal process can be carried out using just the Eddy current probe, or just the CMM, or a combination of both. It will be understood also that the abrasive water jet apparatus 22 can be operated so that it removes only a TBC coating 14 having an irregular surface configuration from a particular workpiece using the mapping step described above, or it can be operated so that it removes only the bond coat 12 and diffusion layer 16 from a particular workpiece using the detection step, or it can be operated to remove the TBC coating, the bond coat 12 and the diffusion layer 16 from a particular workpiece.

In the preferred embodiment of the present invention, the mapping tool 40 may be a CMM that utilizes a Model LP2 touch probe manufactured and sold by Renishaw Company in Schaumberg, Ill., but other equivalent CMMs can also be used. This touch probe 40 engages the surface being mapped and generates electronic signals representing the point of contact with the surface, which is a function of the height of the coating at the point of contact, and these signals are transmitted to the control system 38 which is programmed to store the signals and then use the signals in determining the operation of the abrasive jet apparatus 22 to apply a greater abrasive force for removing the higher spots on the surface and less abrasive force at the lower spots, all as described above.

It is also preferred that the detection device 42 be a x-ray fluorescence device such as an XFR analyzer, Model Nitron XLP, sold by Thermo Electric in Billerica, Mass., which is suited for detecting Yttrium and some other elements. If the unique element in the coating or diffusion layer being detected is other than Yttrium as discussed above, it may be necessary to use other equivalent analyzers designed to detect that unique element.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. A method of removing a bond coat diffusion bonded to a base metal and removing the diffusion layer between the bond coat and the base metal, the diffusion layer having an element that is unique to the diffusion layer, such method comprising the steps of:

(a) removing the bond coat material by moving an abrasive water jet relative to the bond coat and the base metal in multiple passes and in sequential steps;

(b) detecting the presence or absence of the unique element in the diffusion layer after predetermined passes of the abrasive water jet; and (c) stopping the material removing operation of the abrasive water jet when the presence of the unique element is no longer detected.

2. A method of removing a bond coat and diffusion layer as defined in claim 1, wherein the detection step includes using an x-ray fluorescence detector, and moving the detector relative to the surface in which the presence or absence of the unique element is to be detected.

3. A method of removing a bond coat and diffusion layer as defined in claim 2, wherein the unique element in the diffusion layer is Yttrium, and wherein the detecting step includes using an XFR analyzer to detect the presence or absence of the Yttrium.

4. A method of removing a bond coat and diffusion layer as defined in claim 2, in which the abrasive water jet apparatus includes a workpiece holder for holding the surface to be detected relative to the abrasive water jet, and wherein the method includes the step of positioning the abrasive water jet generally adjacent the detector device so that the detector device can move relative to the surface during the material removal step and the abrasive water jet can move relative to workpiece during the element detection step.

5. Abrasive water jet apparatus for of removing a bond coat that is diffusion bonded to a base metal of a workpiece in which a diffusion layer having at least one element unique to the diffusion layer is present is formed between the bond coat and the base metal, such apparatus including:

(a) a workpiece holding system for holding and moving the workpiece;

(b) a movable abrasive water jet that discharges a high pressure jet of water having an entrained abrasive material against and along the moving workpiece held by the work holding system to remove the bond coat and the diffusion layer at variable material removal rates;

(c) a detection device mounted generally adjacent the work holding system so that the detection device moves relative to the workpiece and the detection device detects the presence or absence of the unique element in the diffusion layer of the movable workpiece and transmits electrical signals that indicate whether the unique element is present or absent; and (d) a control system that receives the signals from the detection device and controls the movement and operation of the abrasive water jet to cause the abrasive water jet to make multiple passes relative to the surface of the workpiece in which a small layer of material is removed during passes of the abrasive water jet, and to stop the further removal of material by the abrasive water jet when the control system receives a signal from the detection device indicating the absence of the unique element.

6. Abrasive water jet apparatus as defined in claim 5, wherein the detection devices detects the amount of the unique element that is present at the surface of the diffusion layer during passes of the detection device relative to the workpiece, wherein the signals transmitted to the control system by the detection device indicate the amount of the unique element that is present at the surface of the diffusion layer, and wherein the control system determines the amount of the unique element that is removed during predetermined passes of the detection device and determines the differential between the amount of the unique element that is removed during such passes, and wherein the control system controls the operation of the abrasive water jet to increase the material removal rate when the differential is less than a predetermined amount and to decrease the material removal rate when the differential is greater than a predetermined amount.

* * * * *